US009555314B2

(12) United States Patent
Groenenboom

(10) Patent No.: US 9,555,314 B2
(45) Date of Patent: Jan. 31, 2017

(54) STABLE SKATEBOARD TRUCK

(71) Applicant: Mark Groenenboom, Wyoming, MI (US)

(72) Inventor: Mark Groenenboom, Wyoming, MI (US)

( * ) Notice: Subject to any disclaimer, the term of this patent is extended or adjusted under 35 U.S.C. 154(b) by 0 days.

(21) Appl. No.: 14/720,752

(22) Filed: May 23, 2015

(65) Prior Publication Data

US 2016/0339329 A1 Nov. 24, 2016

(51) Int. Cl.
*A63C 17/01* (2006.01)

(52) U.S. Cl.
CPC ..... *A63C 17/012* (2013.01); *A63C 17/013* (2013.01)

(58) Field of Classification Search
CPC .... A63C 17/011; A63C 17/012; A63C 17/013
USPC ..... 280/87.01, 87.021, 87.041, 87.042
See application file for complete search history.

(56) References Cited

U.S. PATENT DOCUMENTS

2009/0273152 A1* 11/2009 Chung ..... B62K 3/002 280/87.042

* cited by examiner

*Primary Examiner* — John Walters
(74) *Attorney, Agent, or Firm* — Robert Anton Pasic

(57) ABSTRACT

The device pertains to providing a vertically compliant rear truck for a skateboard. This truck provides a truck axle which allows only a single vertical compliance and a single rotational compliance. This provides stability a high speeds and compliance for steering and "pumping" the skateboard.

8 Claims, 18 Drawing Sheets

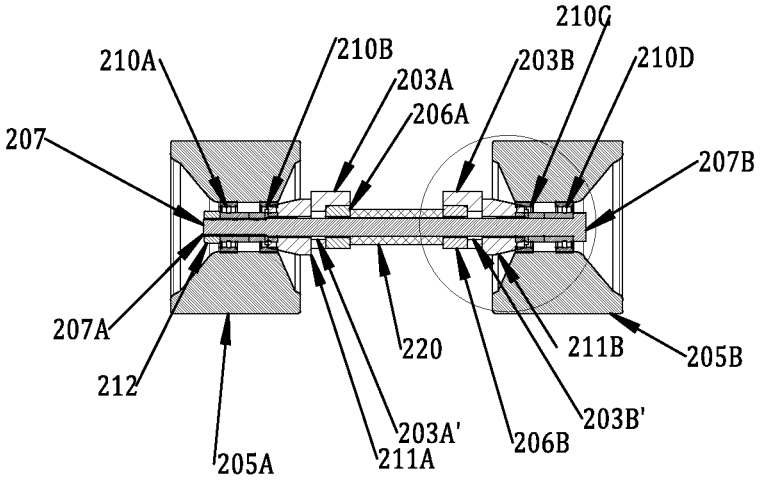
FIGURE 20
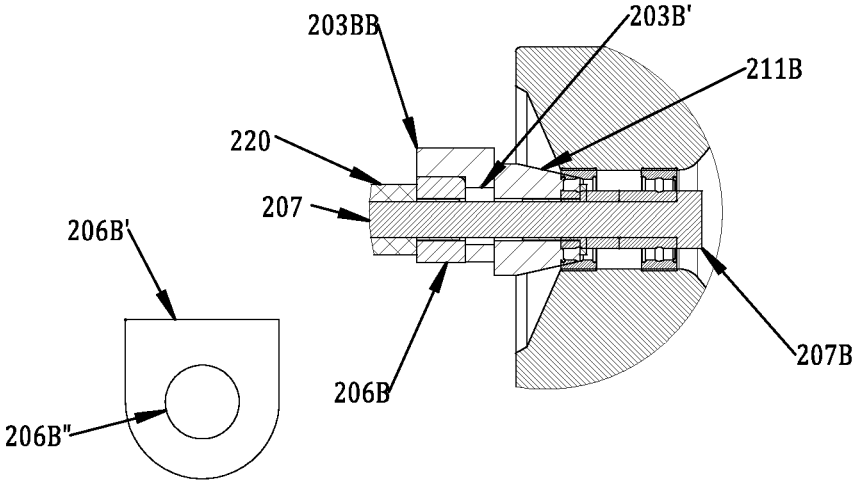
FIGURE 22
FIGURE 21

STABLE SKATEBOARD TRUCK

CROSS-REFERENCE TO RELATED APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO SEQUENCE LISTING, A TABLE, OR A COMPUTER PROGRAM LISTING COMPACT DISC APPENDIX

Not applicable.

BACKGROUND

This application relates to the skateboard industry and specifically to skateboarding as a form of transportation, exercise, and high speed downhill skateboarding. During higher speeds, the skateboard operator typically travels longer distances and in a relatively straight line. Additionally, this skateboard provides a means of pumping to propel oneself, with quick turns, while remaining stable at higher speeds.

Some of the preferred embodiments include a skateboard with a truck similar to the cited prior art for steering, this truck will be referred to as a steering truck and another truck which is constrained to two degrees of freedom. The steering truck has offset axes which allow the skateboard to turn, and in some cases, provide propulsion. This propulsion is explained in prior art U.S. Pat. No. 8,454,038 O'Rourke column 6 lines 44 thru 54. The latter truck restricts the axle compliance to vertical displacement of each wheel independent of each other and rotationally about an axis perpendicular to this vertical displacement. The combination of this truck with the steering truck mentioned above, uniquely allows for propulsion and stability at higher speeds.

Current solutions exist addressing the instability. One solution is referred to as a zero angle truck and is specifically designed with a pivot angle of zero degrees. However, this solution relies on the skateboard platform to provide all structural support. By providing both structure and the compliance needed for performance, this invention eliminates weight, complexity and cost from the skateboard system.

Also noteworthy is that the bushings that provide spring back in this traditional truck type of design are mechanically disadvantaged as the pivot angle goes to zero and is prone to wear more quickly when the deck is tilted repeatedly for turning.

It has been found that at higher speeds the axle in the steering truck can start to oscillate about a vertical axis causing the steering truck to turn back and forth in an uncontrollable manner. One can understand that if all trucks on the skateboard are allowed to react in this fashion the operator would tend to lose control. Therefore, understanding this undesired problem the inventor has provided a truck which allows a steering truck to operate as required for control but reduces steering within its own mechanics, thus providing a more stable experience especially at higher speeds.

An embodiment includes a rear axle which is compliant in two degrees of freedom. This compliance is characterized with flex and spring in the degrees of freedom. One embodiment includes an axle support that has vertical compliance and rotational compliance about an axis parallel to the direction of travel. The approximate location and orientation of these degrees of freedom will be discussed in more detail below. Additionally, the rotational degrees of freedom are described as having directions in the form of vector components this will be explained in more detail with reference to FIG. 7 in the detailed description.

The prior art cited in U.S. Pat. No. 8,454,038 O'Rourke teaches a bidirectional propulsion caster assembly which enables a rider to generate bi-directional motion from a ride-on device (page 1 abstract). This patent teaches the benefits of an angularly offset wheel axis as stated in column 4 line 41 thru 43 of the detailed description. This patent goes on to tout the ability of the offset axis to create an obtuse or acute angle of the caster shaft, see column 5 line 3 thru 13 of the detailed description. It is understood that this device also has an undesirable axle oscillation effect at higher speeds.

Other prior art is cited which includes U.S. Pat. No. 7,341,260 Hosoda. This patent teaches a single offset axis arrangement and the use of a torsion spring. This torsion spring is situated such that it prevents jamming of the offset axis during steering of the skateboard. As stated in the detailed description, the rotational axis of the wheels and the offset axis connected to the base of the skate board are not perpendicular to the plane of the base, see column 2 lines 45 thru 54. This truck device is understood to have stability issues at higher speed, caused again, by axle oscillation.

FIGS. 23, 24, 25 and 26 shows a zero degree truck 100. The zero degree truck 100, allows the axle 104 to pivot about an axis 101. FIG. 24 shows the axle 104 which is supported by the axle housing 105. Each end of the axle 104 has two bearings 103A, 103B, 103C and 103D; these bearings support the wheels 102A and 102B in the usual manner.

FIG. 25 shows a vertical pin 107 which is supported by compliant bushings 106A and 106B and also is rotationally attached to the axle housing 105. The axle housing 105 supports the axle 104. By twisting the base 110, the compliant bushings 106A and 106B are loaded against the pin 107, the axle housing 105 and the washer 109. The axle housing 105 includes a pivot support feature 105A which allows the axle housing 105 to pivot inside a wear bushing 108. In this embodiment the spring back function resisting the twisting is provided by twisting the compliant bushings 106A and 106B. This device however does not reduce cost, decrease the weight and does not provide for strong spring back characteristics. For instance as the compliant bushings 106A and 106B wear the spring back function is adversely effected causing for a less enjoyable experience.

Other prior art exists which includes the use of a skateboard truck that is modified to prevent the wheels from turning as the base is twisted. No actual documentation is available; however, this type of truck is very similar to the truck of U.S. Pat. No. 7,341,260.

Many of the above cited prior art includes skateboard trucks that include two pivoting axes that require additional hardware. This additional hardware has some undesirable consequences such as increased cost and weight and tended to increase the height of the skateboard base. The increased height of the base has been determined to cause a less comfortable experience for the user.

Another problem with the cited prior art is the response of the skateboard to "spring back" to the untwisted or horizontal orientation. This spring back is addressed in cited prior art of U.S. Pat. No. 7,341,260 to Hosoda. This patent teaches the inclusion of a spring (labeled item 22) which provides spring back into a horizontal position of the skateboard base.

The instant invention addresses the stability, spring back, cost and weight issues of the above prior art. Many of the embodiments combine spring back and compliance into the structure of the skateboard base. This is accomplished by structural members instead of additional pivoting mechanisms. The use of these compliant structural members increases the overall higher speed skateboarding experience. Additionally, the trailing wheels are positioned away from the trailing end of the skateboard base such that the wheels do not contact the base even during maximum compliance. This interference is typically referred to as "wheel bite".

Some of the preferred embodiments address the issue of stability at higher speeds of a skateboard that allows steering and propulsion. Additionally, each and every issue in the prior art is not addressed by each embodiment. In fact, some embodiments may not address any of the prior art issues mentioned above.

BRIEF SUMMARY

In view of the previously mentioned prior art, the present invention discloses an improved skateboard truck. The present invention provides a more stable skateboard at higher speeds while still providing for lower weight, less cost, responsive spring back and lower height.

In some of the embodiments the stable truck mechanism is fixed to the base of the skateboard. This provides structural support for the rider, spring suspension in the vertical direction and rotation compliance and torsion spring return about an axis in the direction of travel. Specifically, the rotation compliance and torsion spring return (or spring back) allows for easier propulsion sometimes referred to as pumping.

In one embodiment a compliant member in the form of a cantilever beam is constructed as an integral part of the skateboard base. As discussed below, this embodiment allows one end of the board (i.e. skateboard) to pivot while restricting rotation perpendicular to the direction of travel. A steering truck is attached to the opposite end of the skateboard and provides a means of turning the skateboard by twisting.

In another embodiment a U-shaped rod is affixed to the underside of the skateboard. In this embodiment the U-shaped rod is the compliant member and each end of the rod allows independent vertical and rotational compliance. This embodiment can be easier to manufacture and provides for reduced upfront manufacturing costs. Again this embodiment allows the adjacent end of the skateboard to pivot while restricting rotation perpendicular to the direction of travel. This embodiment easily allows adjustment of both the twisting compliance and vertical compliance by changing how far the cantilevered portion is extended from the base. Notice that additional mounting holes 720A, 720B, 720C and 720D are provided. However, this concept could easily be applied to any of the other embodiments.

In yet another embodiment, a channel is affixed to the underside of the skateboard. This channel is further shaped into a fork construction. This construction again provides for compliance of the axle vertically and allows pivoting of the axle. Again the rotation perpendicular to the direction of travel is restricted.

In yet another embodiment, a beam member is affixed to the underside of the skateboard. This embodiment twists this beam member to provide the twisting compliance for turning. This beam member is also considerably stiff to resist the rotation perpendicular to the direction of travel.

An additional embodiment allows for adjustment of the twisting compliance for turning. This embodiment is based on the channel embodiment mentioned above. However, this concept could easily be applied to any of the other embodiments.

In a final embodiment the use of compliant blocks and a U-shaped compliant member are combined to support the axle providing a compliant skateboard truck. This embodiment greatly decreases the cost and complexity of a stable skateboard truck. Two compliant blocks, one on each end of the U-shaped compliant member, are also attached to the axle. Under load the U-shaped compliant member and the compliant blocks again allow for twisting of the stable skateboard truck without adding additional mechanisms or raising the base of the skateboard.

BRIEF DESCRIPTION OF THE DRAWINGS

FIG. 20 is a cross section view of a stable truck with adjustable compliance; this cross section is taken thru the axle.

FIG. 21 is an enlarged detail of an area of FIG. 20.

FIG. 22 is a side view of an adjustable compliance bushing used in the stable truck with adjustable compliance.

DETAILED DESCRIPTION OF PREFERRED EMBODIMENT

Most embodiments are an integral part of a skateboard. The skateboard typically includes a steering truck, a base, a compliant member and a wheel assembly attached to the compliant member.

Figure 7:
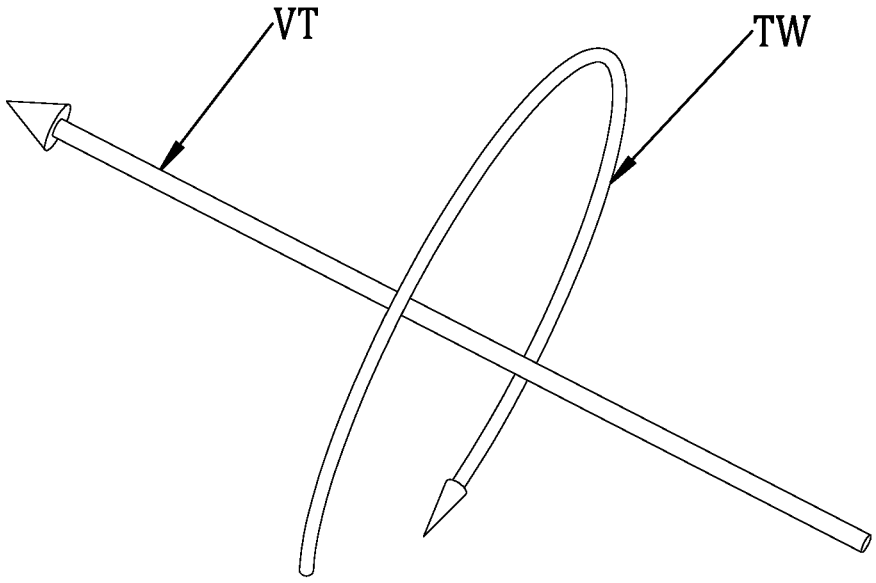
FIG. 7 is a diagram supporting a description of a rotation or twist as a vector.

A quick discussion of twist and angular direction will be helpful. In several engineering texts, vectors are used to describe rotations and angular moment. This vector description traditionally uses the "right hand" rule to determine a vector which is perpendicular to the plane of rotation or twist. Referring to FIG. 7, the twist TW is described as a vector VT. For additional information regarding describing a twist or rotation in terms of vectors can be found in several statics and dynamics engineering textbooks. This type of description is used repeatedly within this document to explain rotation and twist directions.

Figure 3:
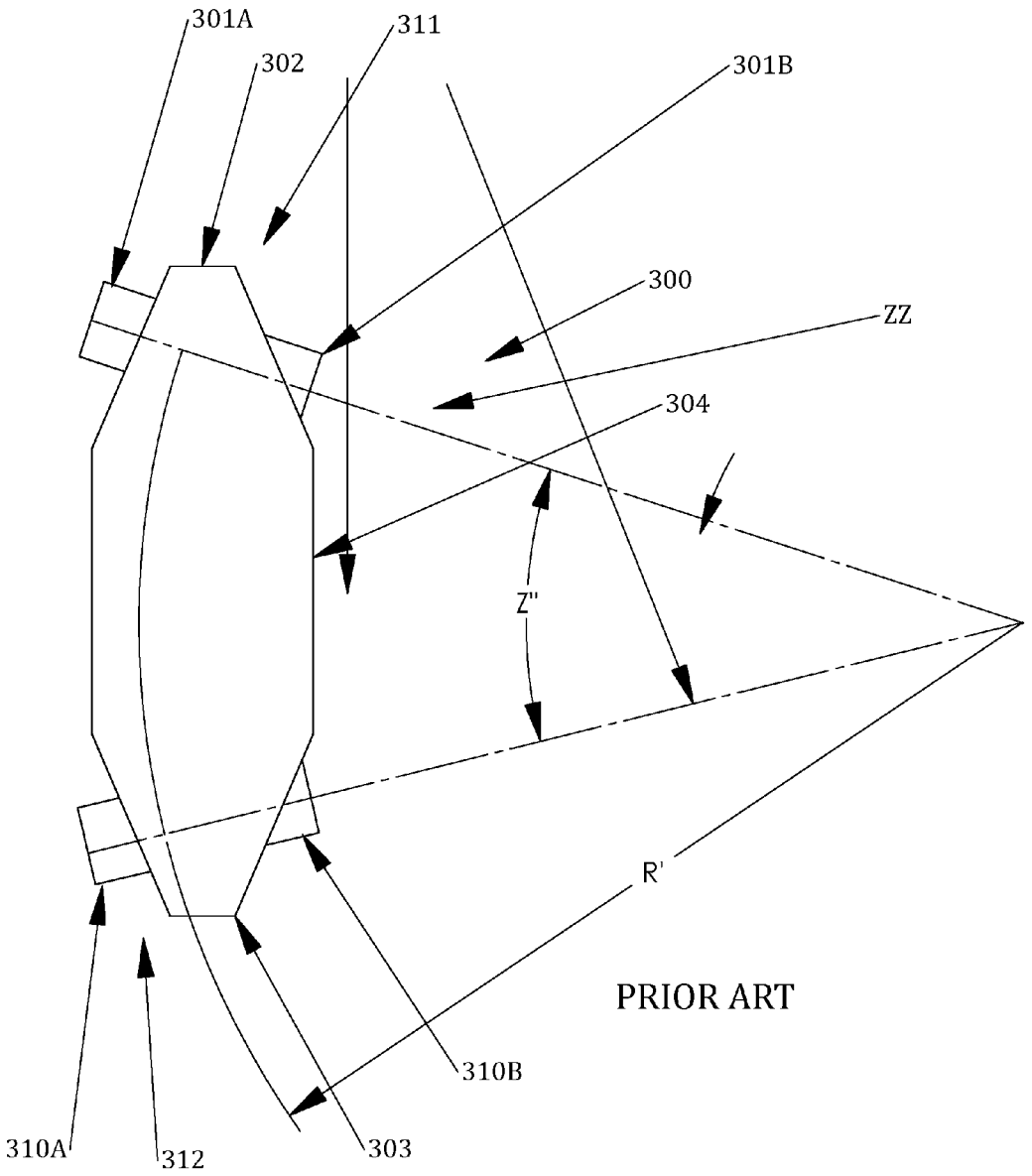
FIG. 3 is a top view of a skateboard constructed of the prior art during a turn.

Next, a brief discussion of the prior art is provided. This discussion is best understood by referring to FIG. 3. As shown in FIG. 3, as the base 304 of the skateboard 300 is twisted the leading and trailing steering trucks 312 and 311 respectively turn the wheels 310A, 310B, 301A and 301B at an angle Z" from the direction of travel illustrated by the arrow ZZ. This causes the skateboard 300 to turn about an arc of radius R'. This is helpful when trying to turn the skateboard 300, however steering trucks 311 and 312 constructed in this manner can have adverse characteristics at higher speeds.

When the skateboard 300 is moving in a straight line, the leading and trailing steering trucks 312 and 311 can start to vibrate rotationally. This is worsened at higher speed as the roughness of the ground causes a vibration force on the wheels 301A, 301B, 310A and 310B. This causes the skateboard front 303 and rear 302 to vibrate. These vibrations hinder control of the skateboard 300. Several of the embodiments address this effect.

Figure 1:
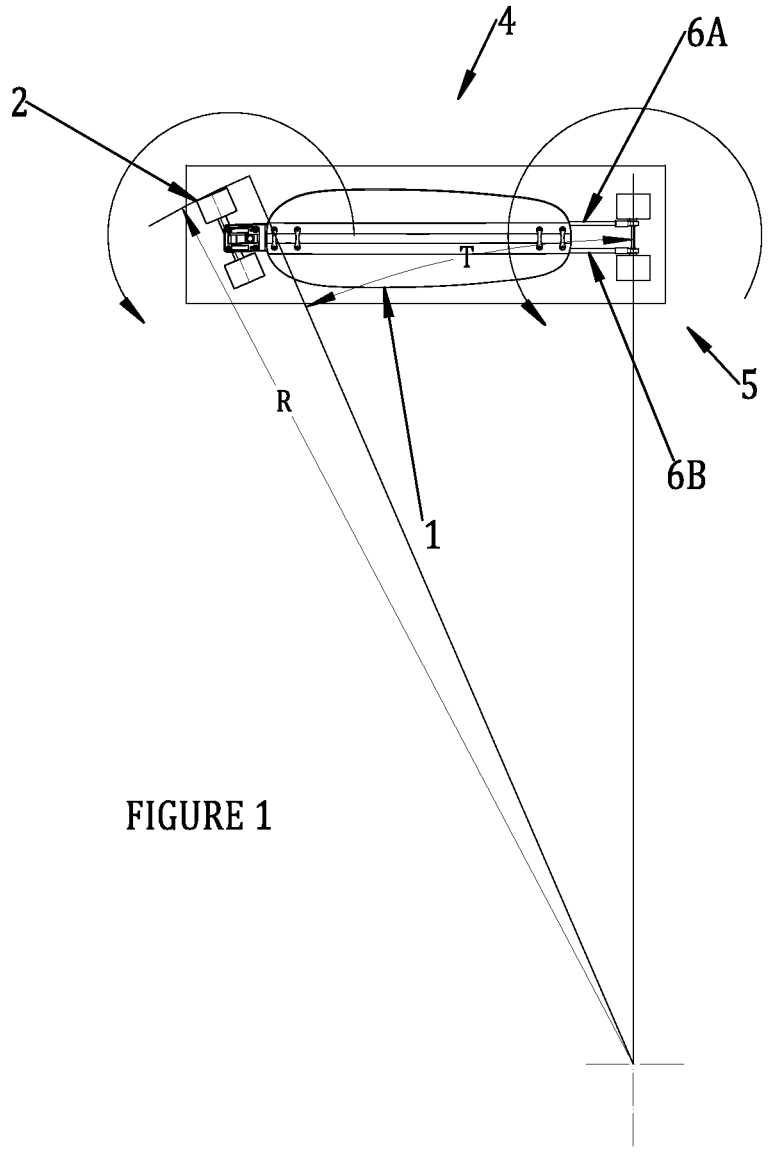
FIG. 1 is a top view of a skateboard with a trailing truck constructed of a U-shaped compliance member during a turn.
Figure 2:
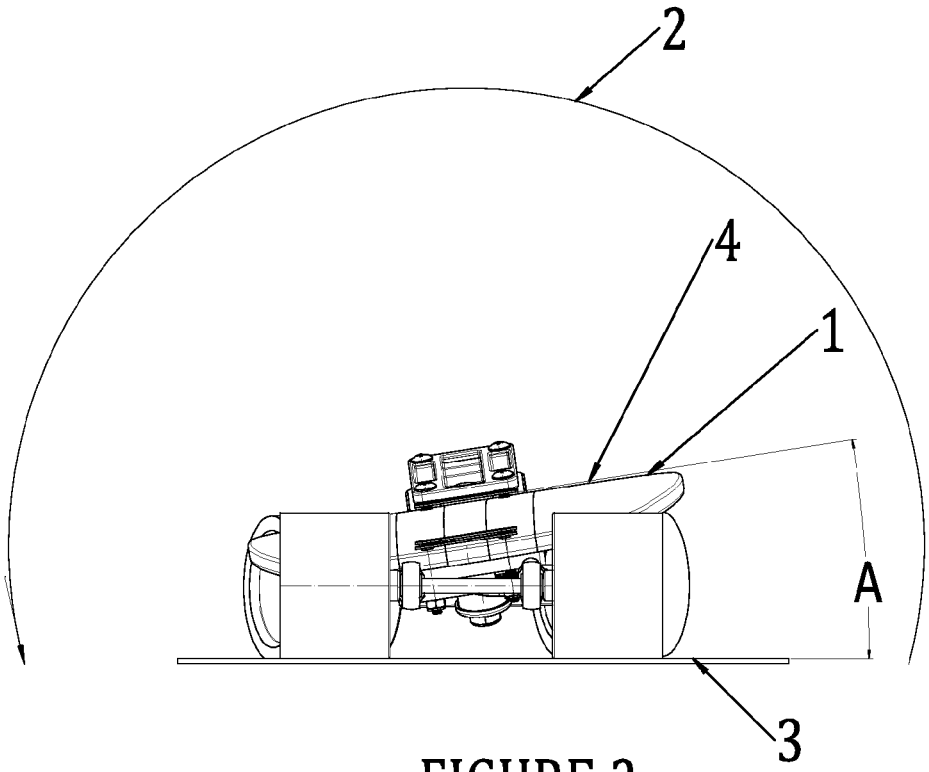
FIG. 2 is a backside view of the skateboard with a trailing truck constructed of a U-shaped compliance member.

Referring to FIGS. 1 and 2 an understanding of the mechanics is provided. FIG. 2 shows the skateboard 4 from the trailing end. Here the base 1 is tilted at an angle A relative to the ground 3. This causes the steering truck 2 to turn to an angle T as shown in FIG. 1. This turning causes the front of the skateboard 4 to follow the steering truck 2. The skateboard 4 begins to follow an arc of radius R.

The following truck 5, again, with the base 1 tilted to an angle A, does not rotate to an angle T. Instead the flexible supports 6A and 6B comply and the following truck 5 continues in a straight line. However, when the skateboard 4 is operated at higher speed, and only needs to make smaller turns, the lack of turning ability in the following truck 5 provides for better control.

Several embodiments are now described in detail and are not considered an exhaustive list, but demonstrate different mechanisms for providing a following truck 5 which allows the operation of a steering truck 2 while maintaining the desired stability of the skateboard 4 at higher speeds.

Figure 4:
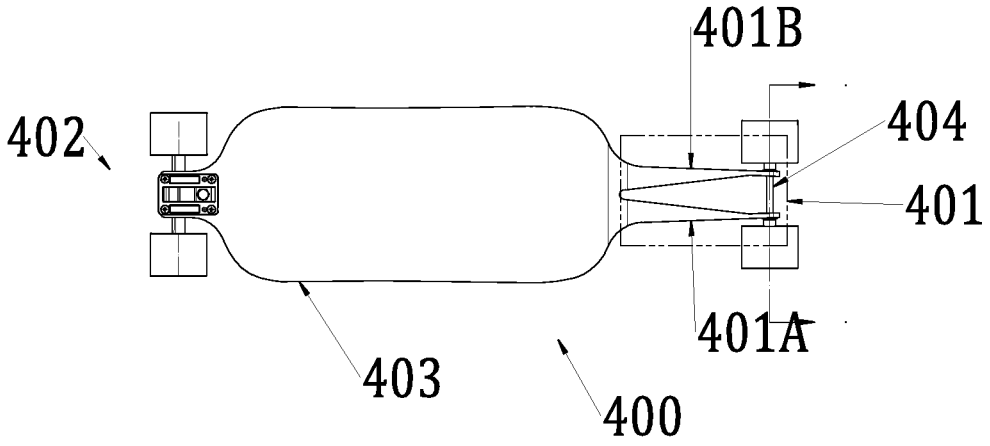
FIG. 4 is a top view of a skateboard with integrated stable truck.
Figure 5:
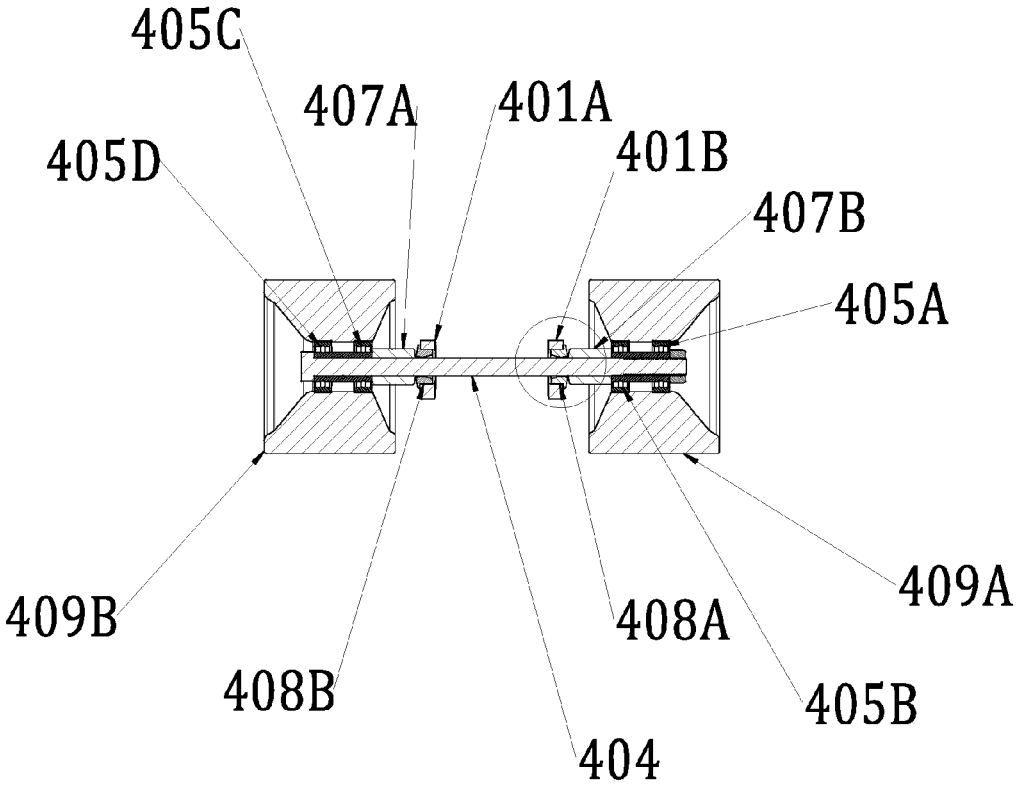
FIG. 5 is a cross sectional view of the integrated stable truck.
Figure 6:
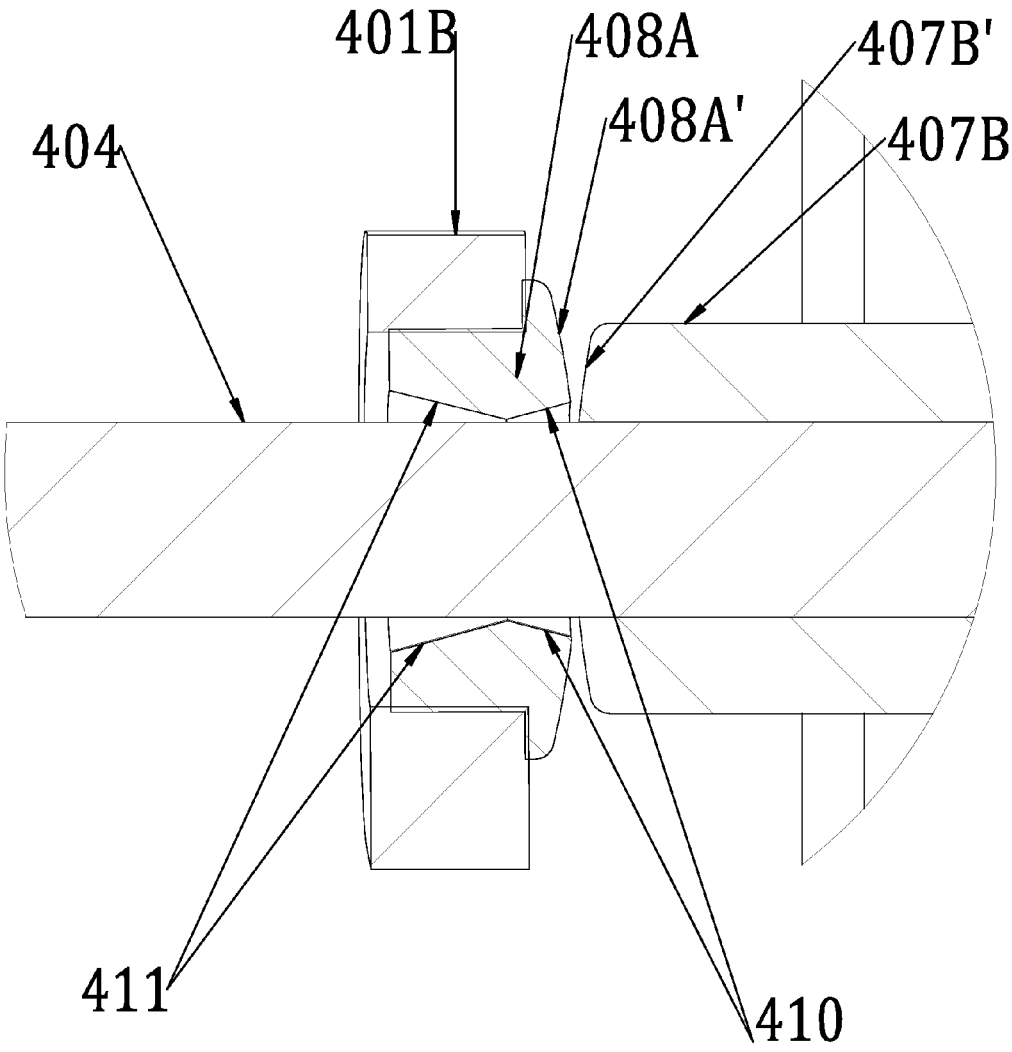
FIG. 6 is an enlarged detail area of FIG. 5.

FIG. 4 shows an embodiment where the skateboard base 403 is a continuous structure which includes a flexible region 401 which consists of two leg features 401A and 401B. These leg features 401A and 401B provide support for the axle 404. Refer now to FIG. 5, the axle 404 in turn supports bearings 405A, 405B, 405C and 405D which are attached to and provide rotation for the wheels 409A and 409B. A spacer 407A is located on the axle 404 and provides for space between the wheel 409A and the leg feature 401A. An additional spacer 407B is located on the axle 404 and provides for space between the wheel 409A and the leg feature 401B. Support for the axle 404 is provided by bushings 408A and 408B. FIG. 6 shows bushing 408A in contact with the axle 404, this bushing 408A includes two chamfered surfaces 410 and 411 which interface with the axle 404. These chamfered surfaces 410 and 411 provide clearance around the axle 404 when the leg feature 401B complies.

Additionally, FIG. 6 shows the bushing 408A includes a spherical surface 408A', this spherical surface 408A' interacts with a second spherical surface 407B' on the spacer 408B. During compliance this interaction allows for relative movement so that the compliance does not cause undesired wear and restriction.

The compliance provided by the leg features 401A and 401B allows the base 403 of the skateboard 400 to twist. This compliance allows the steering truck 402 to turn as discussed above, but prevents the following axle 404 from turning and so turns the skateboard 400.

Figure 9:
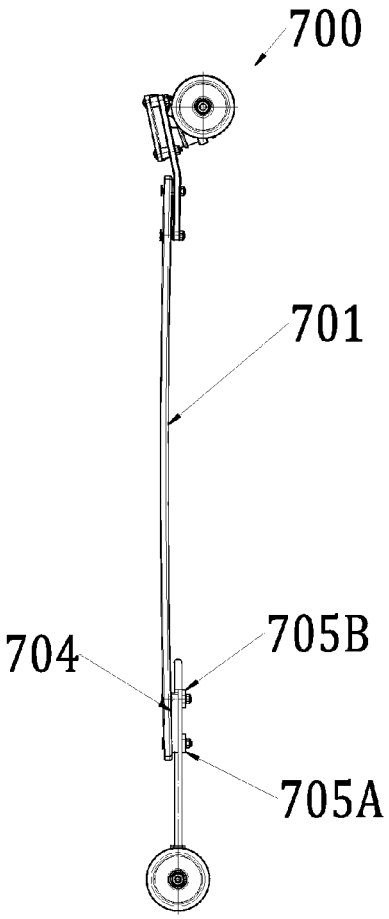
FIG. 9 is a side view of a skateboard with a U-shaped compliance member stable truck.
Figure 8:
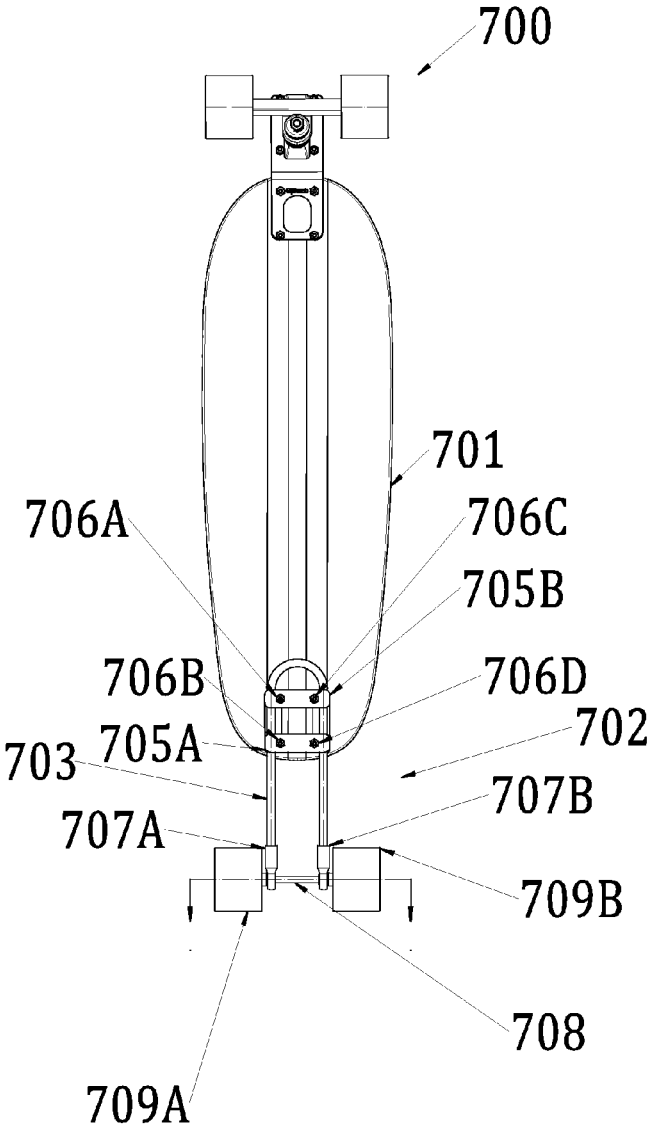
FIG. 8 is a bottom view of a skateboard with a U-shaped compliance member stable truck.

FIGS. 8 and 9 show another embodiment of the invention. This embodiment includes a steering truck 700 on the base 701 and a compliant structure 702 on the other end. This compliant structure 702 includes a U-shaped rod 703 which is attached to the base 701. This attachment is provided by an upper plate 704, lower plates 705A and 705B. The U-shaped rod 703 is clamped between the upper plate 704 and lower plates 705A and 705B using fasteners 706A, 706B, 706C and 706D. These fasteners could be rivets, screws and nuts or a number of solutions for attaching the U-shaped rod 703 to the base 701.

The U-shaped rod 703 could be simply two rods without connection to each other; this U-shaped configuration is simply a preferred implementation.

Each end of the U-shaped rod 703 has a spherical bushing 707A and 707B attached, these bushings provide connection to the axle 708. The axle 708 in turn rotationally supports the wheels 709A and 709B. These connections are discussed in more detail by referring to FIG. 10.

Figure 10:
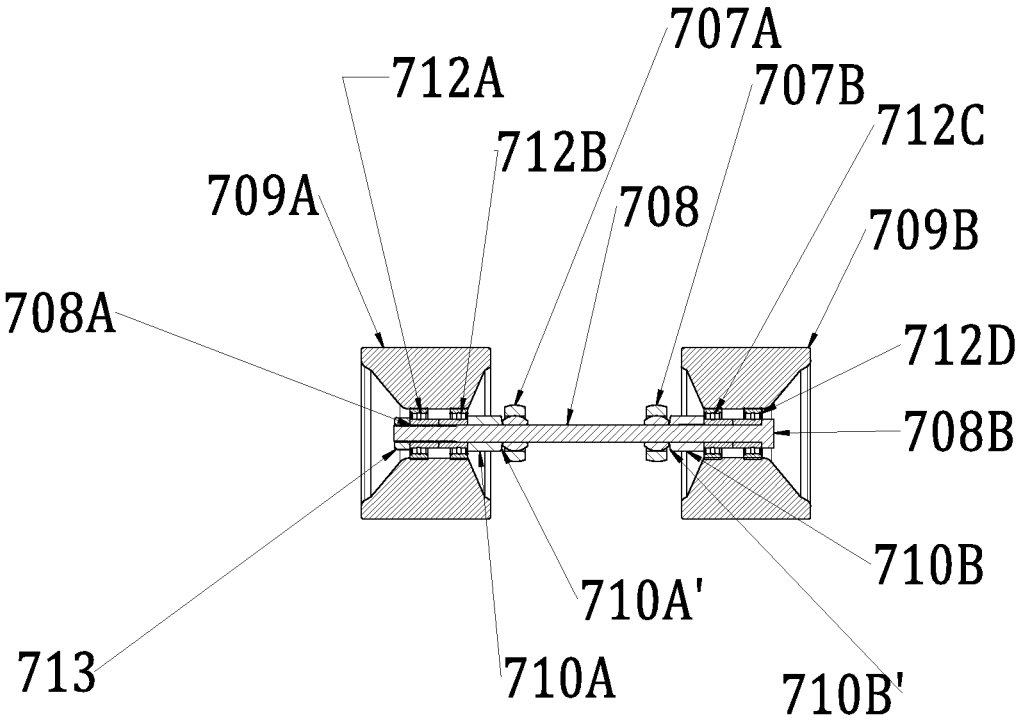
FIG. 10 is a cross sectional view of a U-shaped compliance member stable truck, this cross section is taken thru the axle.
Figure 11:
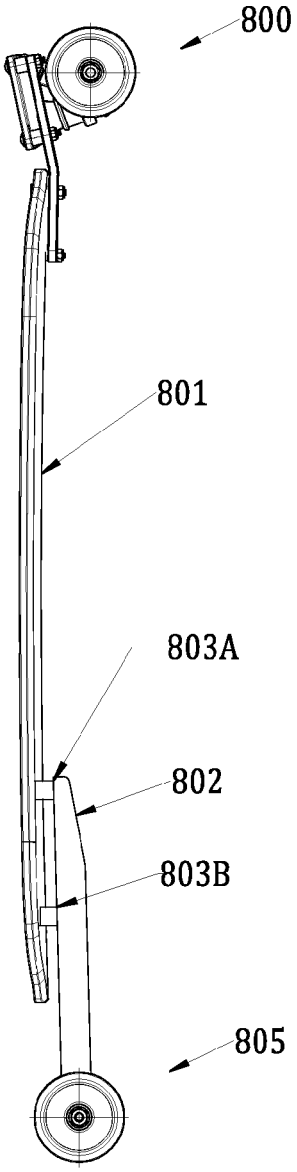
FIG. 11 is a side view of a channel embodiment of a stable truck.

FIG. 10 shows a cross section of the axle 708 and other components. Since the base 701 is twisted to turn the steering truck 700, the compliant structure 702 allows the axle 708 to remain parallel to the ground. This compliance causes the U-shaped rod 703 to twist. Spherical bushings 707A and 707B connect to the axle 708 but allow the U-shaped rod 703 to twist. The wheels 709A and 709B are attached to bearings 712A, 712B, 712C and 712D which are supported by the axle 708. A spacer 710A is positioned axially on the axle 708 between a spherical bushing 707A and a bearing 712B. A similar arrangement is provided using spacer 710B, axle 708, spherical bushing 707B and bearing 712C. The axle 708 includes a head 708B on one end and a threaded portion 708A on the other. A nut 713 is engaged with the threaded portion 708A. As this nut 713 is tightened the head 708B pulls the wheels 709A, 709B, the bearings 712A, 712B, 712C and 712D, the spacers 710A and 710B and spherical bushings 707A and 707B towards each other. This provides a solid structural assembly. Also note the spacers 710A and 710B interface with spherical bushings 707A and 707B and have spherical surfaces 710A' and 710B' for reducing restriction during compliance.

The compliance and spring force provided by the U-shaped rod 703 allows the base 701 to tilt. This compliance allows the steering truck 700 to turn as discussed above but prevents the following axle 708 from turning.

Figure 12:
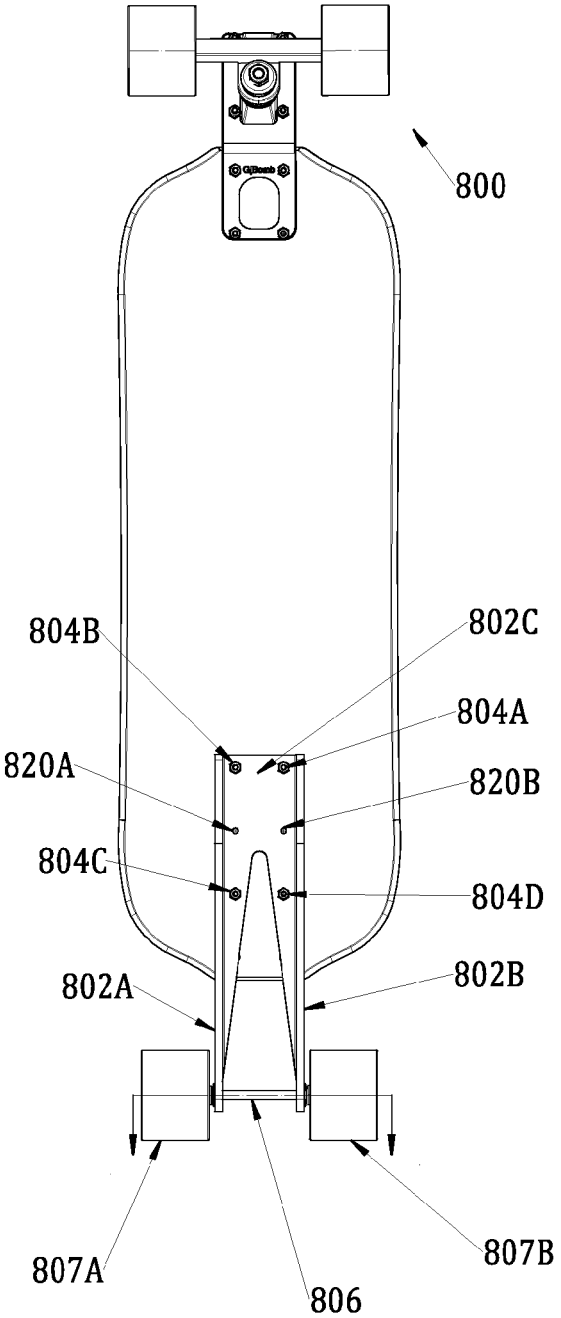
FIG. 12 is a bottom view of a channel embodiment of a stable truck.

Another embodiment is shown in FIGS. 11, 12, 13, and 14. This embodiment includes the steering truck 800, a base 801 and a compliant channel member 802 as part of the compliant truck 805. The compliant channel member 802 is attached to the base 801 by fasteners 804A, 804B, 804C and 804D which clamp the base 801 the spacers 803A and 803B and the channel base 802C. Again several different fastening methods could be used to implement this attachment such as bolts and nuts, rivets, pins etc. As can be seen in FIG. 12 the compliant member 802 includes two legs 802A and 802B, these legs support the compliant truck 805.

Figure 13:
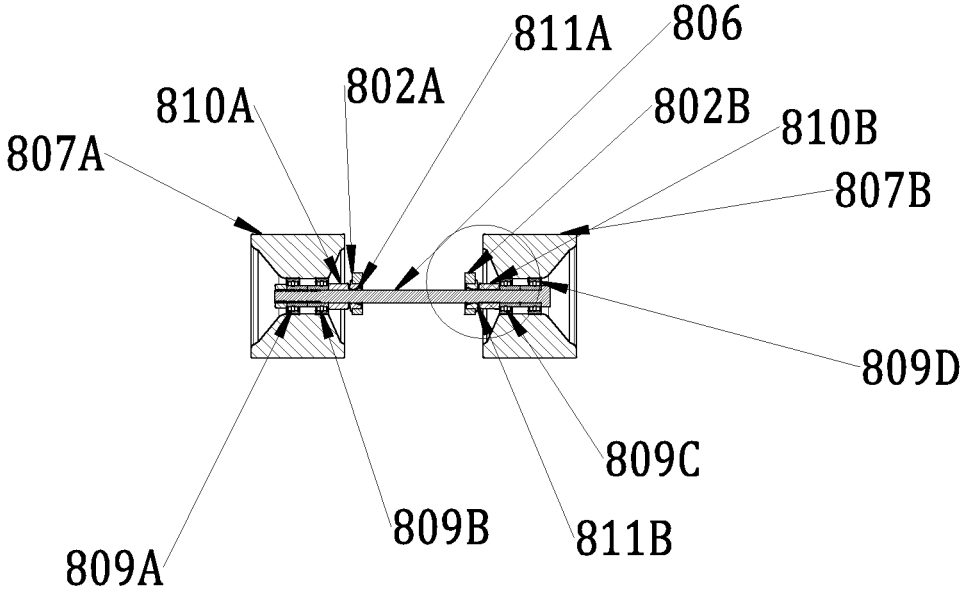
FIG. 13 is a cross sectional view of a channel embodiment of a stable truck, this cross section is taken thru the axle.
Figure 14:
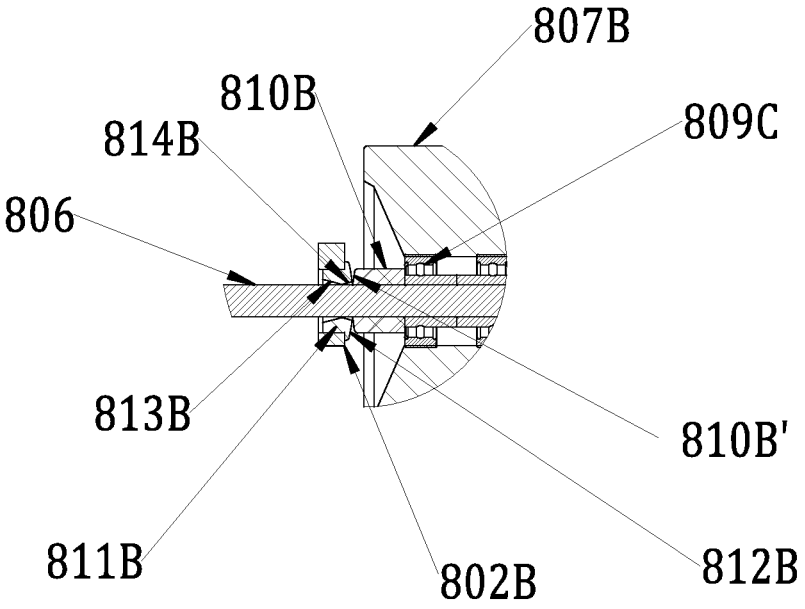
FIG. 14 is an enlarged detail of one area of FIG. 13.

FIG. 13 shows a cross section of the compliant truck 805 at the axle 806. The axle 806 supports bearings 809A, 809B, 809C and 809D which are attached to, and provide rotation for, the wheels 807A and 807B. A spacer 810A is located on the axle 806 and provides for space between the wheel 807A and the leg feature 802A. An additional spacer 810B is located on the axle 806 and provides for space between the wheel 807B and the leg feature 802B. Support for the axle 806 is provided by bushings 811A and 811B. FIG. 14 shows bushing 811B in contact with the axle 806, this bushing 811A includes two chamfered surfaces 813B and 814B which interface with the axle 806. These chamfered surfaces 813B and 814B provide clearance around the axle 806 when the leg feature 802B complies.

Additionally, FIG. 14 shows the bushing 811B includes a spherical surface 812B. This spherical surface 812B interacts with a second spherical surface 810B' on the spacer 810B so that restriction is reduced. During compliance this interaction allows for relative movement so that the compliance doesn't cause undesired wear and restriction.

The compliance provided by the compliant channel member 802 including legs 802A and 802B allows the base 801 to tilt. This compliance allows the steering truck 800 to turn as discussed above but prevents the following axle 806 from turning. The mounting of the compliant channel member 802 also plays a role in the compliance of the truck. FIG. 12 shows additional holes 820A and 820B which can be used to for fasteners 804C and 804D or for fasteners 804A and 804B. This allows for changing the support characteristics of the compliant channel member 802 and so adjusting the compliance of the compliant truck 805.

Figure 15:
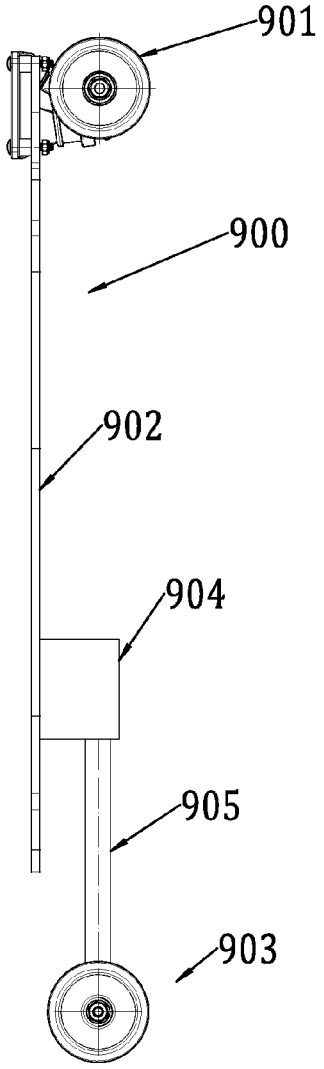
FIG. 15 is a side view of a compliant beam stable truck.
Figure 16:
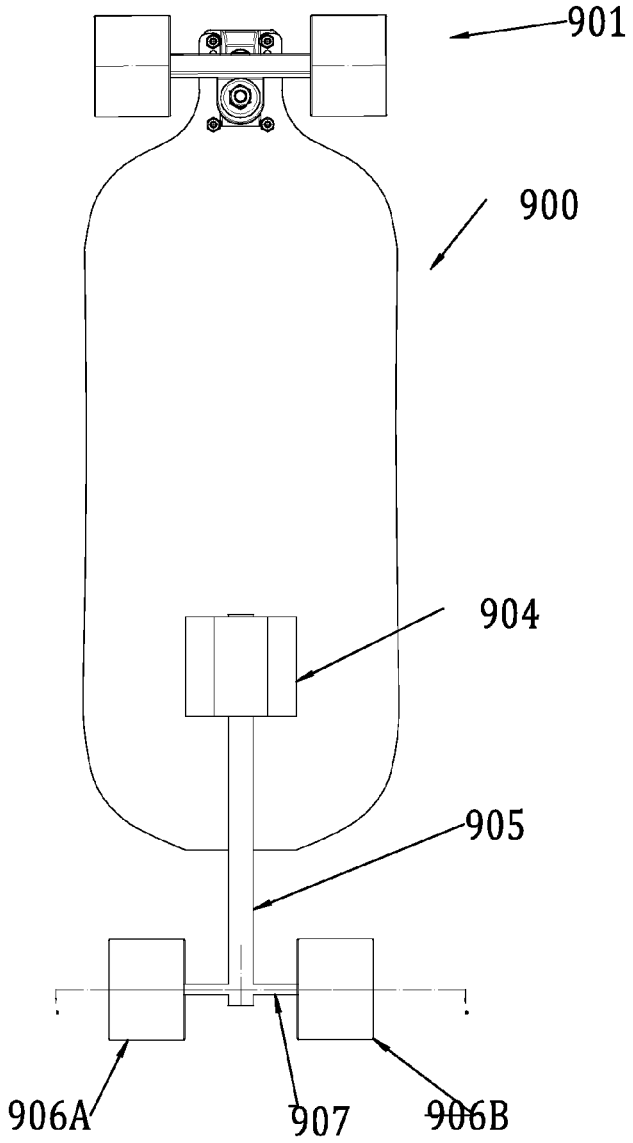
FIG. 16 is a bottom view of a compliant beam stable truck.
Figure 17:
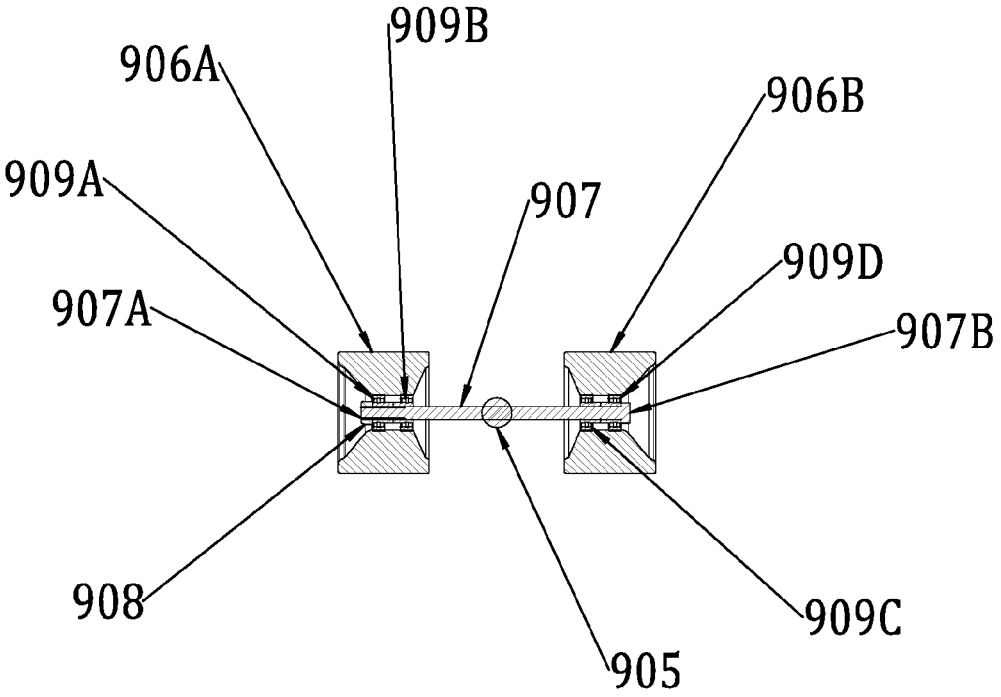
FIG. 17 is a cross sectional view of a compliant beam stable truck, this cross section is taken thru the axle.
Figure 18:
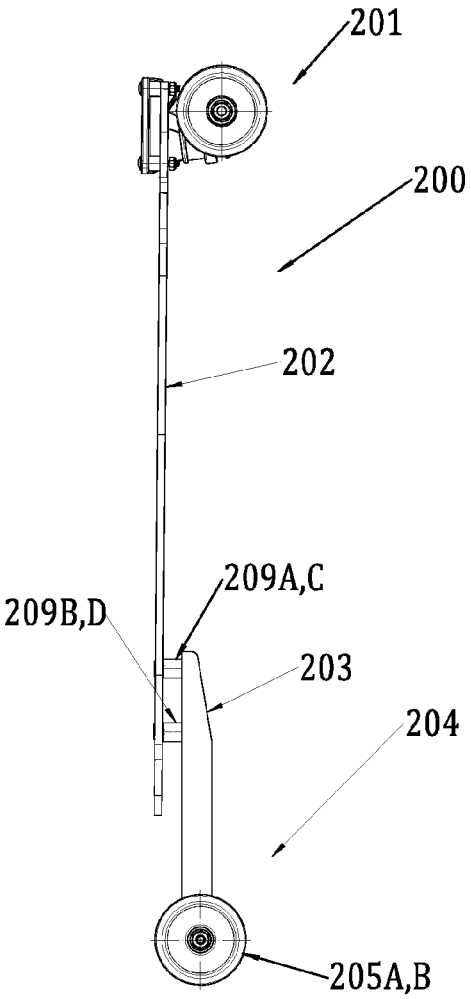
FIG. 18 is a side view of a stable truck with adjustable compliance.
Figure 19:
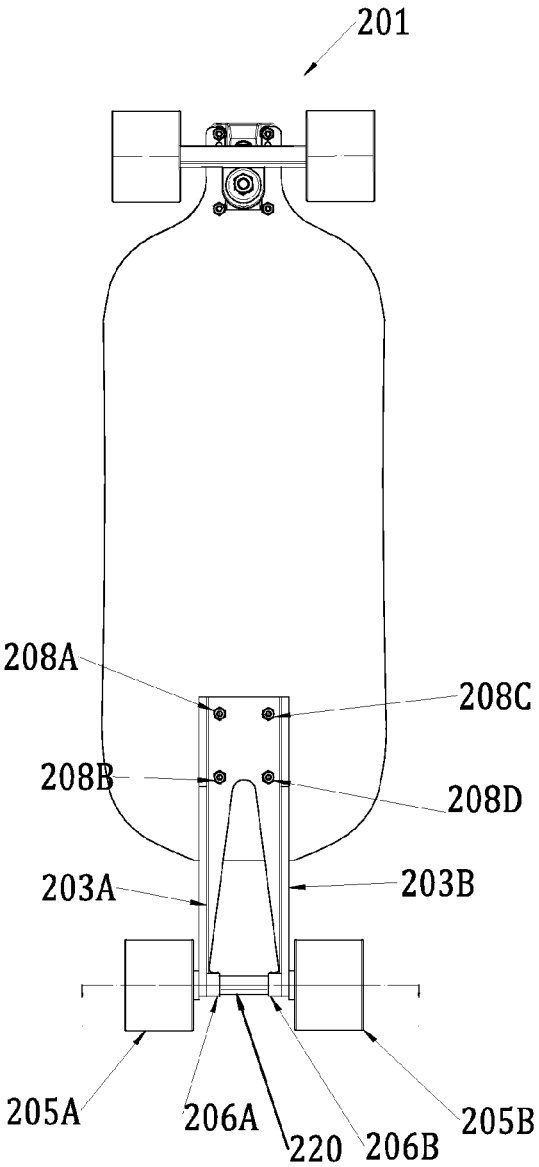
FIG. 19 is a bottom view of a stable truck with adjustable compliance.
Figure 24:
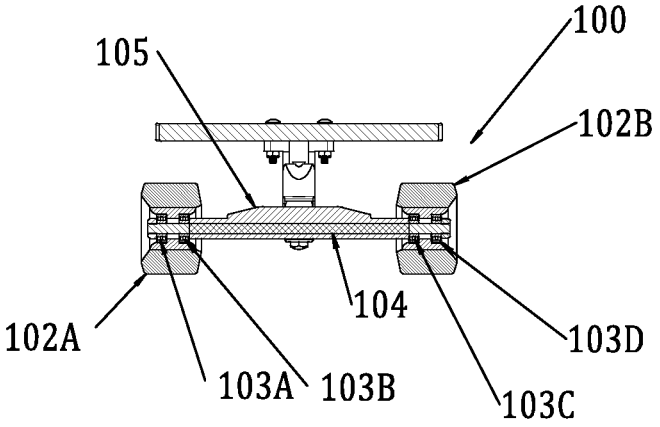
FIGURE 24 PRIOR ART
FIG. 24 is a sectional view of a zero degree truck thru the truck axle.
Figure 25:
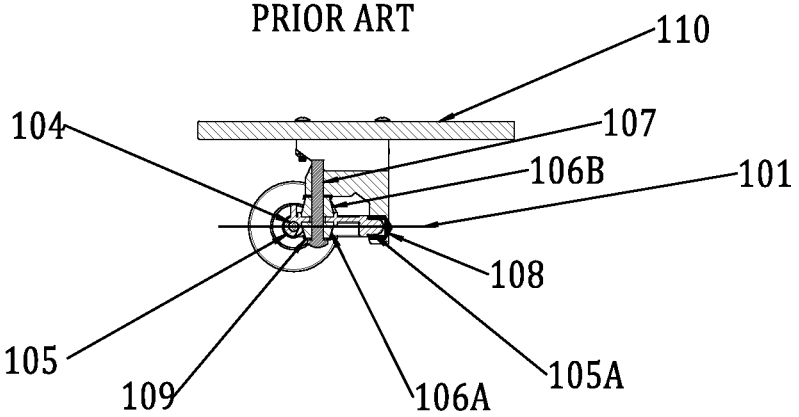
FIGURE 25 PRIOR ART
FIG. 25 is a sectional view of a zero degree truck thru the axle housing.
Figure 23:
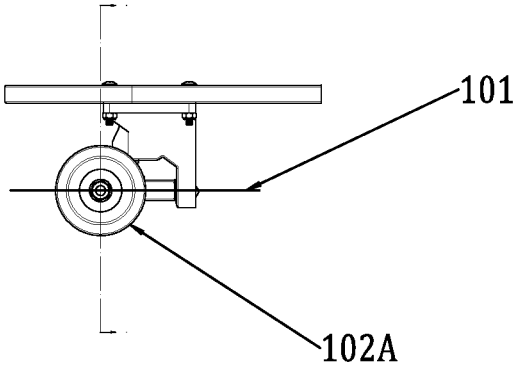
FIGURE 23 PRIOR ART
FIG. 23 is a side view of a zero degree truck and is understood to be prior art.

The next embodiment is shown in FIGS. 15, 16 and 17. The skateboard 900 in this embodiment includes a steering truck 901, base 902 and a beam member 905 as part of a compliant truck 903. A block 904 is attached to the base 902. This base 902 supports a beam member 905 which in this embodiment is a cylindrical rod however this beam member 905 could be a tube of various cross sectional geometry and need not be restricted to a single cross sectional geometry along its length. An axle 907 is attached at the distal end of the beam member 905. The block 904, beam member 905 and axle 907 could be a single piece or combination of several other parts which provide structural support and twisting compliance for the wheels 906A and 906B.

Support for the wheels 906A and 906B is best explained with reference to FIG. 17. Axle 907 includes a head feature 907B, a threaded portion 907A and is attached to the beam member 905, the nut 908 threads onto the threaded portion 907A to clamp the head feature 907B to hold the bearings in place. Bearings 909A, 909B, 909C and 909D are located concentrically with the axle 907 and are rotationally attached to the wheels 906A and 906B.

In this embodiment the beam member 905 allows for twist without redirecting the wheels 906A and 906B. This compliance allows the steering truck 901 to turn as discussed above but prevents the following axle 907 from turning. The compliance of this truck embodiment is adjustable by sliding the beam member 905 into or out of the block 904. This increases or decreases the length of the beam member 905 and so changes the compliance of the compliant truck 903.

The following embodiment is shown in FIGS. 18, 19, 20, 21 and 22. The skateboard 200 of this embodiment again includes a steering truck 201, a base 202 and a compliant truck 204 to be discussed in detail below. A compliant beam 203 is attached to the base 202 using fasteners 208A, 208B, 208C and 208D and standoffs 209A, 209B, 209C and 209D, this compliant beam 203 is very similar to the compliant member 802 above however, additional features are included and provide an additional compliance mechanism.

The compliant beam 203 provides support for the wheels 205A and 205B. This support is further explained by referring to FIGS. 20, 21 and 22. The axle 207 is in contact with compliant bushings 206A, 206B, 211A and 211B. These compliant bushings 206A, 206B, 211A and 211B are inserted over the axle 207 thru an adjacent hole 206B" shown in FIG. 22. Also shown in FIG. 22 is a flat surface 206B', this surface 206B' is assembled to be in intimate contact with a foot feature 203BB of the compliant beam leg 203B. A large opening 203B' is provided in the compliant beam leg 203B, this assures that the bushing 206B carries the supporting load instead of the surface of the hole 203B'. Spacers 211A and 211B are directly positioned between the compliant legs 203A and 203B and the bearings 210B and 210C to provide space between the compliant legs 203A and 203B and the wheels 205A and 205B. The bearings 210A, 210B, 210C and 210D provide rotational support for the wheels 205A and 205B.

A compliance adjustment will now be explained. In FIG. 20 the axle 207 includes a head feature 207B and a threaded portion 207A. A nut 212 is threaded onto this threaded portion 207A. By tightening the nut 212 the bushings 206A and 206B are compressed since a rigid spacer 220 is located between the two bushings 206A and 206B. The bushings 206A and 206B follow the well understood Poisson's effect of elasticity and so as the bushings 206A and 206B are compressed they expand in a radial direction, this causes the surface 206A' to push against the foot feature 20366 shown in FIG. 21. This preloads the bushings 206A and 206B such that the compliance is changed. Since the axle head 207B and nut 212 load both bushings 206A and 206B both compliant legs 203A and 203B are adjusted.

The spacers 211A and 211B are also used to adjust the compliance. Again, as the nut 212 is tightened these spacers 211A and 211B are compressed between the bearing 210B and compliant leg 203B and bearing 210C and compliant leg 203B respectively. Since the twisting of the compliant beam 203 is resisted by these spacers 211A and 211B the compliance is also adjusted.

In this embodiment the compliance allowing for twist without redirecting the wheels 205A and 205B is provided by three devices, a compliant beam 203, compliant bushings 206A and 206B and spacers 211A and 211B. This compliance allows the steering truck 201 to turn as discussed above but prevents the following axle 207 from turning. Additionally, the stiffness and spring back is also adjusted allowing for better control at higher speeds and based on rider preference.

Additionally, compression of the bushings 206A and 206B and spacers 211A and 211B could be provided in a number of other ways including a locking wedge, a cam mechanism similar to a bicycle axle clamp, simply a screw that engages one end of the axle such that as the screw is tightened the distance from the axle head 207B and the screw is modified, and several other common means.

Figure 26:
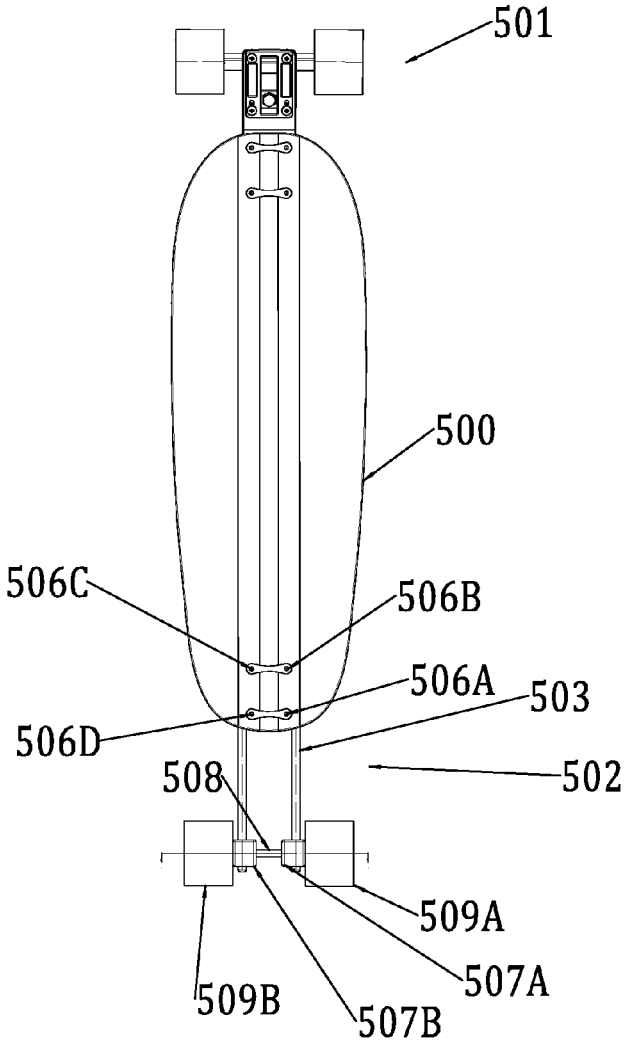
FIG. 26 is a top view of a compliant block truck.
Figure 28:
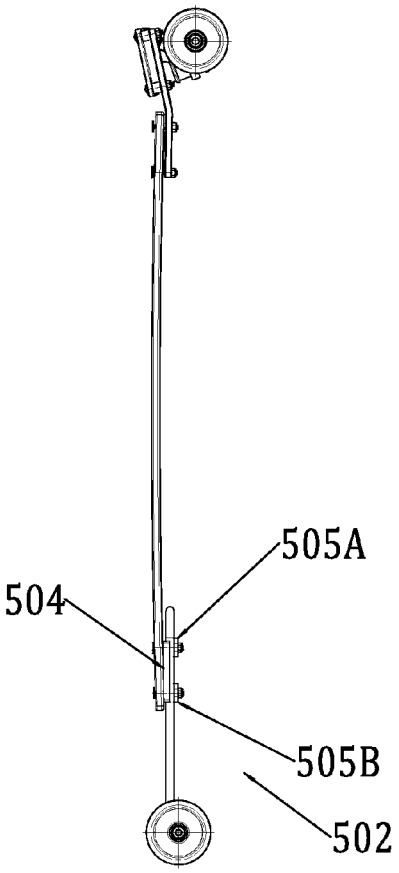
FIG. 28 is a side view of a compliant block truck.
Figure 27:
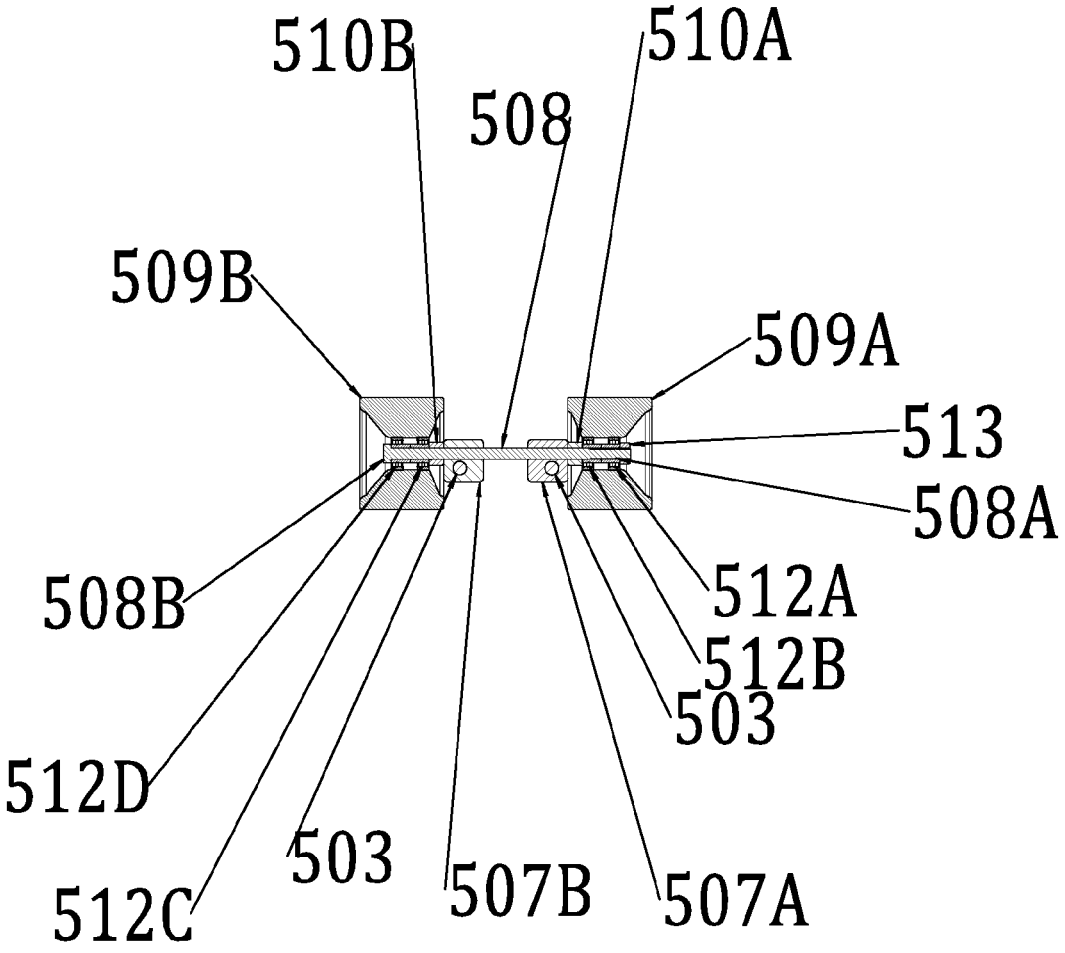
FIG. 27 is a sectional view of a compliant block truck thru the axle.

A final embodiment is shown in FIGS. 26, 27 and 28. This embodiment includes a steering truck 501 on the base 500 and a compliant structure 502 on the other end. This compliant structure 502 includes a U-shaped rod 503 which is attached to the base 500. This attachment is provided by an upper plate 504, lower plates 505A and 5056. The U-shaped rod 503 is clamped between the upper plate 504 and lower plates 505A and 5056 using fasteners 506A, 506B, 506C and 506D. These fasteners could be rivets, screws and nuts or a number of solutions for attaching the U-shaped rod 503 to the base 500.

The U-shaped rod 503 could be simply two rods without connection to each other; this U-shaped configuration is simply a preferred implementation. Additionally, the U-shaped rod can be extended and retracted to adjust the compliance of the compliant truck.

Each end of the U-shaped rod 503 has compliant blocks 507A and 507B attached. These compliant blocks provide connection to the axle 508. The axle 508 in turn rotationally supports the wheels 509A and 509B with bearings 512A, 512B, 512C and 512D. These connections are discussed in more detail by referring to FIG. 27. This embodiment with 2 compliant blocks is one implementation. A single compliant block attached to both ends is also a viable embodiment.

FIG. 27 shows a cross section of the axle 508 and other components. Since the base 500 is twisted to turn the steering truck 501, the compliant structure 502 allows the axle 508 to remain parallel to the ground. This compliance causes the U-shaped rod 503 to twist. Compliant blocks 507A and 507B connect to the axle 508 but allow the U-shaped rod 503 to twist. The wheels 509A and 509B are attached to bearings 512A, 512B, 512C and 512D which are supported by the axle 508. A spacer 510A is positioned axially on the axle 508 between a compliant block 507A and a bearing 512B. A similar arrangement is provided using spacer 5108, axle 508, compliant block 507B and bearing 512C. The axle 508 includes a head 508B on one end and a threaded portion 508A on the other. A nut 513 is engaged with the threaded portion 508A. As this nut 513 is tightened the head 508B pulls the wheels 509A, 509B, the bearings 512A, 512B, 512C and 512D, the spacers 510A and 5108 and compliant blocks 507A and 507B towards each other. This provides a solid structural assembly.

The compliance and spring force provided by the U-shaped rod 503 and the compliant blocks 507A and 507B allows the base 500 to tilt. This compliance allows the steering truck 501 to turn as discussed above but prevents the following axle 508 from turning.

It will be understood that while the invention has been described in conjunction with specific embodiments thereof, the foregoing description and examples are intended to illustrate, but not limit the scope of the invention. Other aspects, advantages and modifications will be apparent to those skilled in the art to which the invention pertains, and these aspects and modifications are within the scope of the invention, which is limited only by the appended claims.

I claim:

1. A skateboard having a leading end and a trailing end comprising:

a: a base for connecting said leading and trailing ends;

b: a steering truck attached to said leading end for directing said leading end; and c: a compliant truck attached to said trailing end for providing rotational compliance in a direction essentially parallel to a line from said leading end and said trailing end, said compliant truck comprising;

i) a compliant member including a foot feature and an adjacent hole;

ii) an axle located in said adjacent hole;

iii) at least one bushing with a surface in contact with said foot feature; and iv) a means of compressing said bushing such that said flat surface is pressed against said foot feature.

2. The skateboard of claim 1 wherein said compliant member is a flexible region which is a continuous feature of said base.

3. The skateboard of claim 1 wherein said compliant member is a compliant channel member.

4. The skateboard of claim 3 wherein said compliant channel member includes:

a: first compliant leg for supporting said axle; and b: a second compliant leg for supporting said axle.

5. The skateboard of claim 3 wherein said channel member includes additional holes for mounting said channel member to said base.

6. The skateboard of claim 3 wherein said compliant member is a beam member.

7. The skateboard of claim 6 wherein said beam member is mounted in a block which is attached to said trailing end of said base for supporting said beam member, said block allows for sliding said beam member for adjusting the length of said beam member for adjusting the compliance of said compliant truck.

8. The skateboard of claim 7 wherein said beam member is fixed to said axle for supporting said axle.

* * * * *